US006508616B2

(12) United States Patent
Hung

(10) Patent No.: US 6,508,616 B2
(45) Date of Patent: Jan. 21, 2003

(54) BUCKET FASTENER FOR A HYDRAULIC SHOVEL

(76) Inventor: Bing-Wen Hung, No. 13, Hsiang-Yang-Hsin-Tsun, Hsi-Ho Rd., Chen-An Village, Wu-Chieh Hsiang, I-Lan Hsien (TW)

( * ) Notice: Subject to any disclaimer, the term of this patent is extended or adjusted under 35 U.S.C. 154(b) by 0 days.

(21) Appl. No.: 09/866,118

(22) Filed: May 25, 2001

(65) Prior Publication Data

US 2002/0176772 A1 Nov. 28, 2002

(51) Int. Cl.[7] ..... E02F 3/00
(52) U.S. Cl. ..... 414/723; 37/468; 172/274
(58) Field of Search ..... 414/723; 37/468; 172/274; 403/321, 322.1, 322.3, 324, 325

(56) References Cited

U.S. PATENT DOCUMENTS 4,560,300 A * 12/1985 Vollmer et al. ..... 403/11
4,810,162 A * 3/1989 Foster ..... 414/723
6,058,633 A * 5/2000 Barden ..... 37/468

* cited by examiner

*Primary Examiner*—Kathy Matecki
*Assistant Examiner*—Michael Lowe
(74) *Attorney, Agent, or Firm*—Kolisch Hartwell, P.C.

(57) ABSTRACT

A bucket fastener for a hydraulic shovel is assembled between an arm of the hydraulic shovel and a dipper bucket. The bucket fastener has a body pivotally mounted with the arm and a vertical link. A fixed hook is formed at a front end of the body. A movable seat is provided in the body and has a movable hook formed thereon. By the fixed hook attaching a first axle, and the movable hook attaching a second axle, the dipper bucket is securely fastened on the fastener.

11 Claims, 7 Drawing Sheets

BUCKET FASTENER FOR A HYDRAULIC SHOVEL

BACKGROUND OF THE INVENTION

1. Field of the Invention

The present invention is related to a hydraulic shovel, and more particularly to a bucket for the hydraulic shovel.

2. Description of Related Art

A hydraulic shovel is a machinery widely used in construction industry. A hydraulic shovel generally is composed of a boom (as an upper arm of a human) extending from beside a cab and controlled by a boom cylinder, an arm (as a forearm of a human) pivotally mounted at a distal end of the boom and controlled by an arm cylinder, and a dipper bucket (as a hand of a human) pivotally mounted at a distal end of the arm and controlled by a bucket cylinder. Moreover, a lateral link and a vertical link are respectively pivotally mounted with the arm and the dipper bucket.

When the dipper bucket is replaced with another one, the pins between the bucket and the arm, and between the bucket and the vertical link must be disassembled and re-assembled while a new dipper bucket is mounted. This process is time-consuming and need about 40 minutes for a specialized worker.

Therefore, the invention provides a bucket fastener to mitigate and/or obviate the aforementioned problem.

SUMMARY OF THE INVENTION

The main objective of the invention is to provide a bucket fastener to facilitate an operation of attaching/detaching a dipper bucket on a hydraulic shovel.

Other objects, advantages and novel features of the invention will become more apparent from the following detailed description when taken in conjunction with the accompanying drawings.

DETAILED DESCRIPTION OF THE PREFERRED EMBODIMENT

Figure 1:
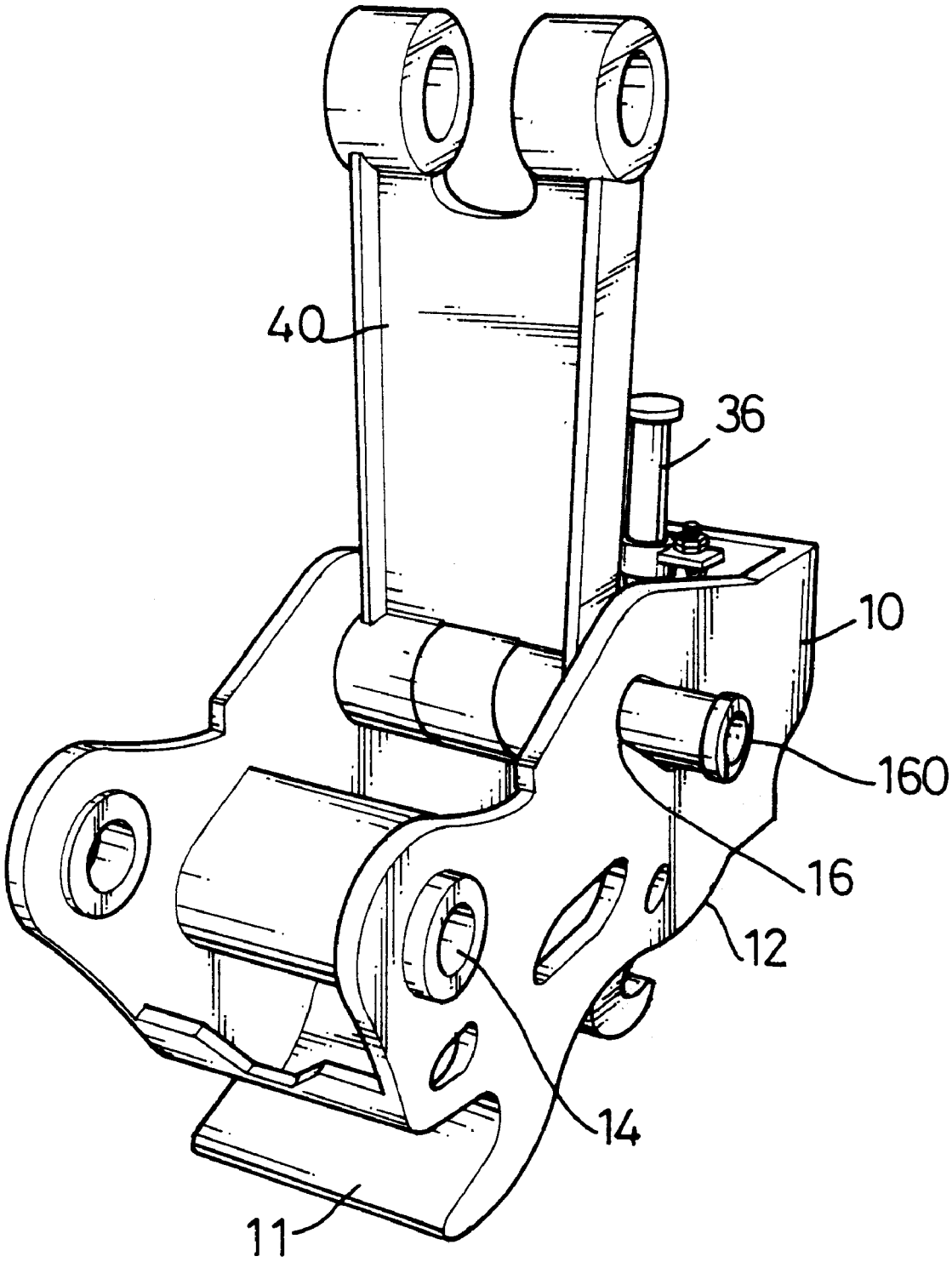
FIG. 1 is a perspective view of a bucket fastener for a hydraulic shovel in accordance with the invention.
Figure 2:
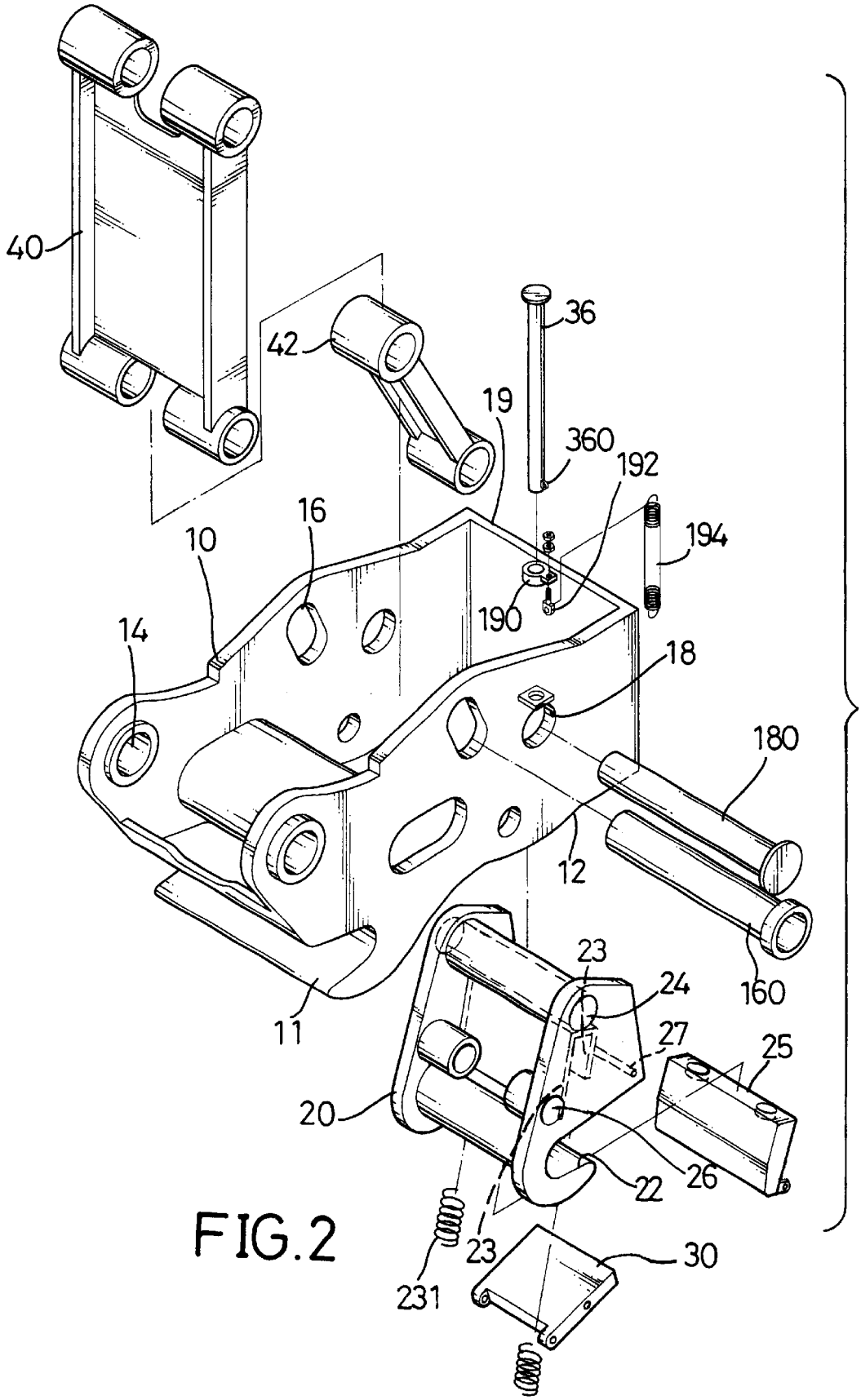
FIG. 2 is an exploded perspective view of the bucket fastener.

Referring to FIGS. 1 and 2, a bucket fastener in accordance with the present invention has a hollow body (10) formed as a "U" with two opposite side walls (not numbered) and an end plate (19). A fixed hook (11) is formed at a front bottom end of the body (10) and opposite the end plate (19) at a read end of body (10). The side walls each have an arcuate edge (12) formed at a bottom thereof. A pair of arm holes (14) is respectively defined at upper front ends of the side walls, and a pair of link holes 916) is respectively defined at middle portions of the side walls. A first pivot pin (160) is movably inserted through the link holes (16) to pivotally mount a first end of a vertical link (40) on the body (10). A pair of first pivot holes (18) is respectively defined beside the link holes (16) for a second pivot pin (180) inserted therethrough. A ring (190) is formed on the inner wall of the end plate (19) and a spring fastener (192) is formed on a periphery of the end plate (190). A pole (36) is vertically inserted through the ring (190) and has an opening (360) defined at a lower end thereof. A first spring (194) a first end of which is secured at the spring fastener (192) and a second end of which is attached to the opening (360) of the pole (36).

A movable seat (20) assembled in the body (10), has a movable hook (22) formed at a front end thereof. A second pivot hole (24) is defined at an upper end of the movable seat (20) and aligned with the first pivot holes (18) for the second pivot pin (180) to be inserted therethrough. A pair of third pivot holes (26) is defined at a front side and between the movable hook (22) and the second pivot holes (24). A short link (42) has a first end pivotally mounted in the third pivot holes (26) and a second end pivotally mounted with the first end of the vertical link (40). A bar (27) is formed at a rear bottom end of the movable seat (20) and a chamber (23) is formed in the seat (20). At least one recoil spring (231) (two are shown in this preferred embodiment) is received in the chamber (20) and one end of which abuts an end wall of the chamber (20). A baffle plate (25) is movably received in the chamber (23) to which the other end of the recoil spring (231) abuts, so that when the baffle plate (25) is pressed inside the chamber (23), the recoil spring (231) is able to provide sufficient recoil force to the baffle plate (25) to return the baffle plate (25) to its original position. A lever (30) is pivotally connected with the baffle plate (25) at a first distal edge of the lever (30) and a second distal edge of the lever (30) is selectively engaged with the bar (27) to prevent excess movement of the lever (30).

Figure 3:
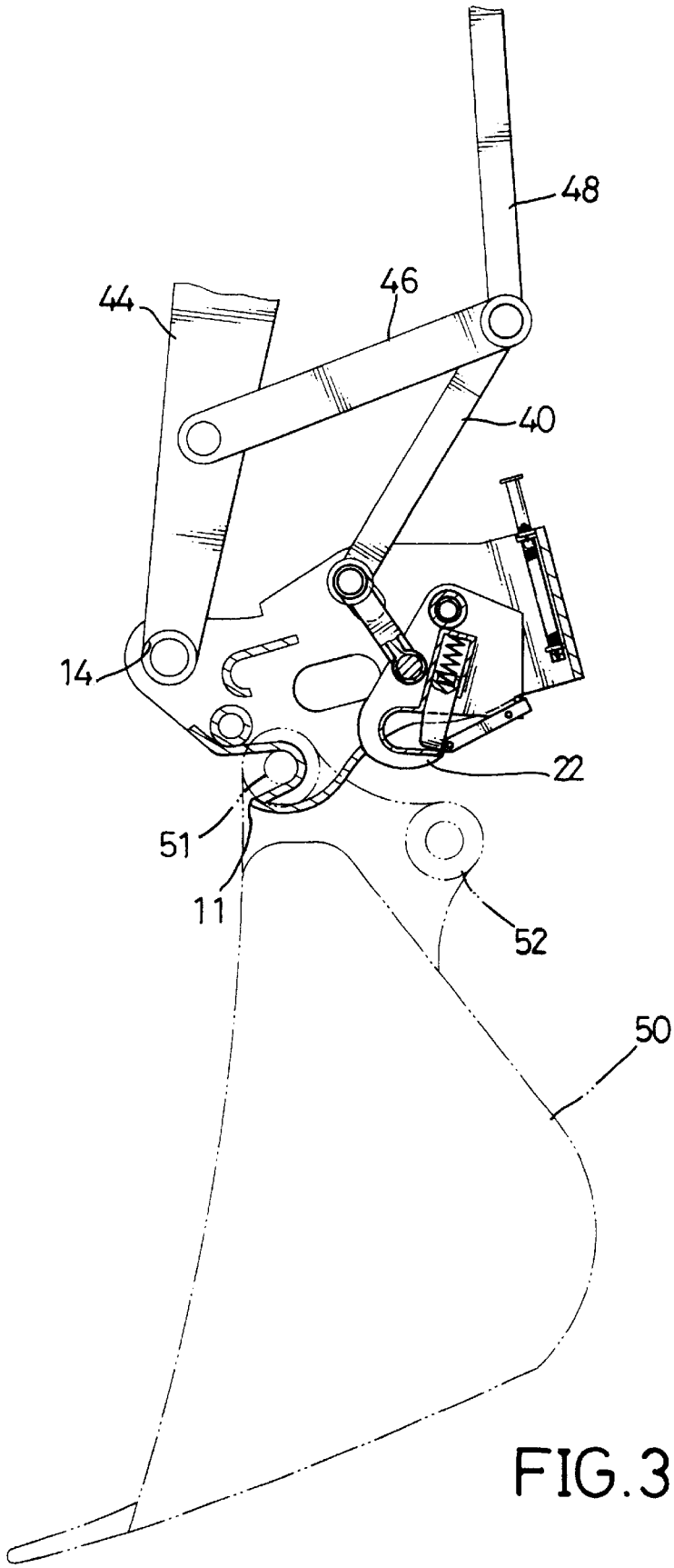
FIG. 3 is a schematic view showing that a first axle of a bucket is attached by a fixed hook of the fastener, and a second axle of the bucket is not attached by a movable hook of the fastener.

With reference to FIG. 3, when the baffle plate (25) and the lever (30) are assembled, the baffle plate (25) is able to be pushed by the lever (30). An arm (44) of a hydraulic shovel is pivotally mounted on the arm holes (14). A lateral link (46) has a first end pivotally mounted with a second end of the vertical link (40). An actuating link (48) is pivotally mounted with the second end of the lateral link (46) and the second end of the vertical link (40). FIG. 3 shows that a first axle (51) of a dipper bucket (50) is attached by the fixed hook (11), and a second axle (52) of the bucket (50) corresponds to the hook (22) of the seat (20) so that the second axle (52) is able to be seated in the space defined by the hook (22).

In this case, by the deadweight of the body (10), the first pivot pin (160) abuts a top end of the link hole (16), and the movable seat (20) is retracted in the body (10) by the short link (42). Thus, a distance between the fixed hook (11) and the movable hook (22) is decreased.

Figure 4:
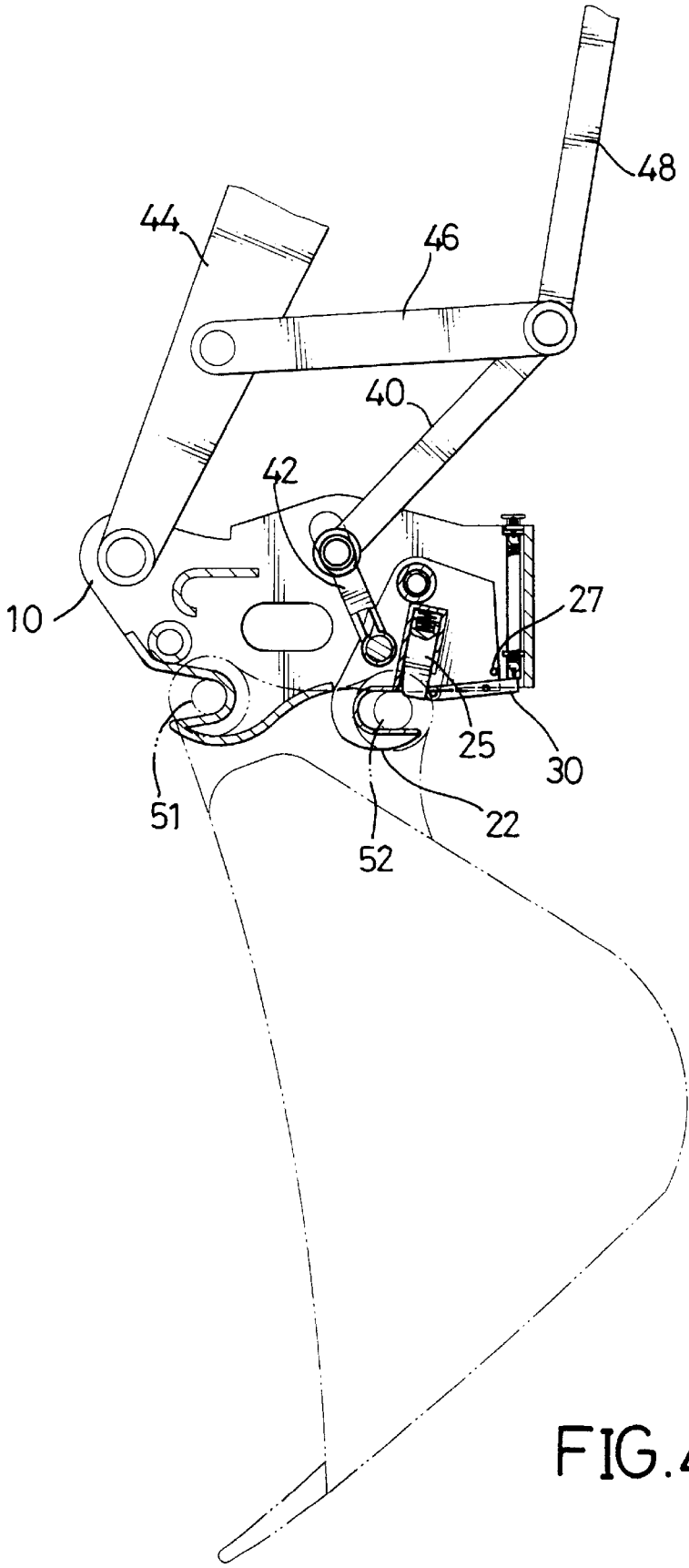
FIG. 4 is a schematic view showing that the second axle of the bucket is being attached by the movable hook of the fastener.

Afterwards, with reference to FIG. 4, the actuating link (48) is pushed forwards, and by the lateral link (46) and the vertical link (40), the body (10) is pivoted downwards about the first axle (51). When the body (10) continues to pivot about the first axis (51), the outer periphery of the movable hook (22) engages the second axis (52) and gradually engages with the lever (30). When the lever (30) engages with the second axis (52), the lever (30) pushes the baffle plate (25) to open the space defined by the movable hook (22) and thus the second axis (52) is able to be received in the movable hook (22). After the second axis (52) is received in the space of the movable hook (22), because the abutting force to the lever (30) vanishes and consequently the force abutting the baffle plate (25) is zero, the baffle plate (25) closes the space of the movable hook (22) to secure the second axis (52) inside the movable hook (22).

Figure 5:
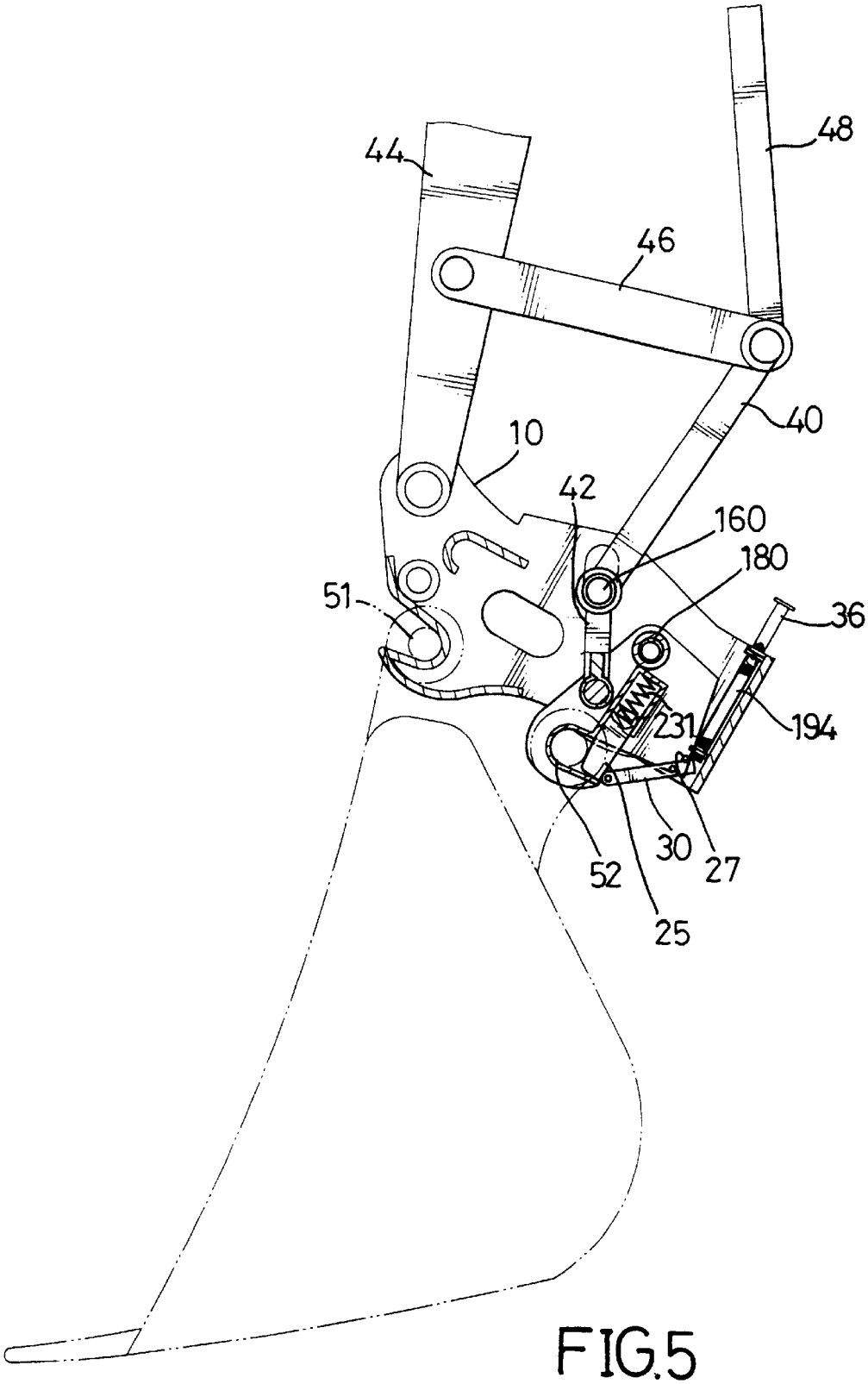
FIG. 5 is a schematic view showing that the bucket is securely fastened on the bucket fastener in accordance with the invention.

To be more specifically, as shown in FIG. 5, when the actuating link (48) is pushed continuously, because the body (10) is blocked by the second axle (52) and is unable to pivot downwards, the first pivot pin (160) is moved down along the link hole (16) to arrive at a bottom end of the link hole (16) and pushes the movable seat (20) to pivot about the second pivot pin (180). Then, the movable hook (22) receives the second axle (52). Moreover, under the force of the recoil spring (231), the baffle plate (25) pushes against an outer periphery of the second axle (52). Thus, the second axle (52) is securely fastened by the movable hook (22) and the baffle plate (25).

Similar to a conventional dipper bucket, the dipper bucket (50) fastened in accordance with the invention is also operated by the arm (44) and a bucket cylinder (not shown or numbered).

Figure 6:
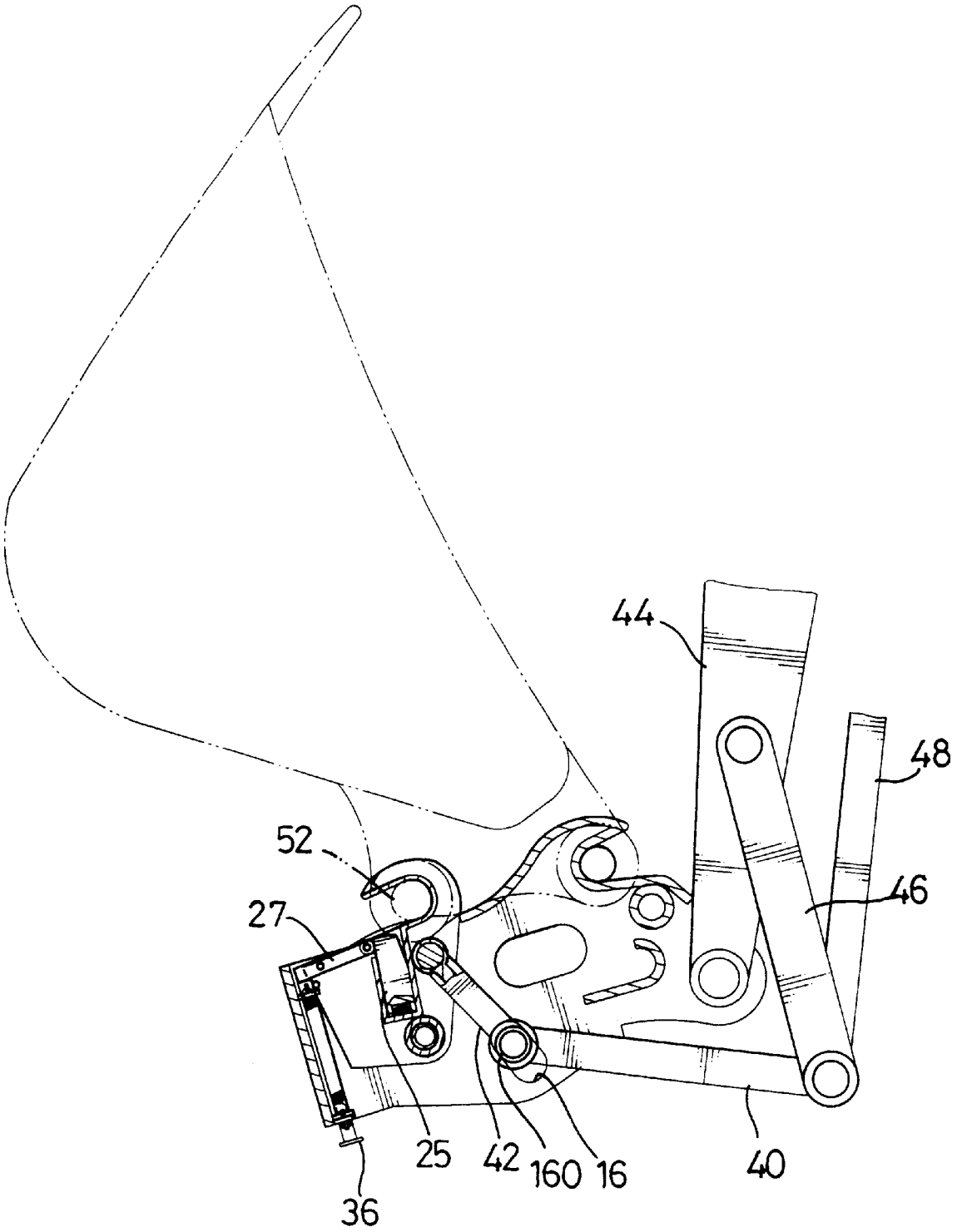
FIG. 6 is a schematic view showing that the bucket fastener is turned reversedly for detaching the bucket by a pole.
Figure 7:
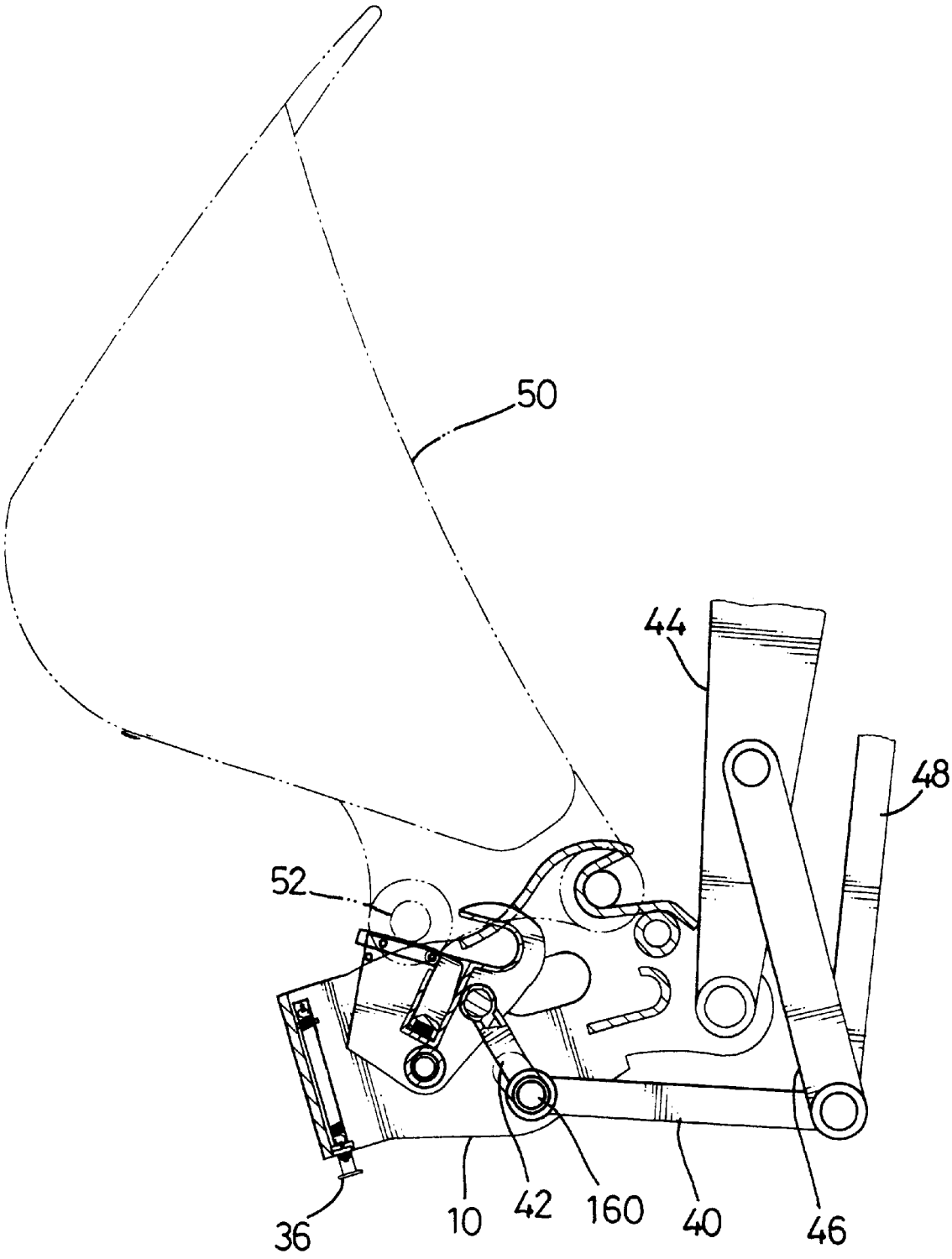
FIG. 7 is a schematic view showing that the second axle of the bucket is disengaged from the movable hook.

Referring to FIGS. 6 and 7, for detaching the bucket (50), the bucket (50) is pivoted inwards to close the arm (44), and the body (10) is pivoted reversedly and a top end of the pole (36) faces to the ground. Afterwards, the bucket (50) and the body (10) are moved downwards to force the pole (36) moving into the body (10) by the ground. The rear portion of the lever (27) is pushed by the pole (36) and thus the baffle plate (25) is pushed accordingly to move away from the engagement with the second axle (52). After the baffle plate (25) disengages with the second axle (52), the actuating link (48) is moving upward, which gradually drives the vertical link (40) to move. The movement of the vertical link (40) drives the first pivot pin (160) to move in the link hole (16). Thus, the short link (42) drives the hook (22) to move, which allows the total disengagement of the second axle (52) from the hook (22) and thus the bucket (50) is able to easily disengage with the body (10).

According to the present invention, it is very easy and rapidly for an operator to change the bucket for the hydraulic shovel. Thus, it saves a lot of time, and increases the utilizing efficiency of the hydraulic shovel.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bucket fastener for a hydraulic shovel, the bucket fastener being assembled between an arm of the hydraulic shovel and a dipper bucket, and comprising:

a body (10) pivotally mounted with the arm (44), the body (10) having a fixed hook (11) formed at a front bottom end thereof and being suitable to receive therein a first axle of the dipper bucket, a pair of link holes (16) and a pair of first pivot holes (18) respectively defined at two opposite side walls thereof, a first pivot pin (160) and a second pivot pin (180) respectively inserted through the link holes (16) and the first pivot holes (18), wherein the first pivot pin (160) is movable along the link holes (16), and an end plate (19) formed at a rear end thereof, the end plate (19) having a ring (190) formed thereon, a pole (36) inserted through the ring (190), and a first spring (194) having a first end secured on the ring (190) and a second end attached to the pole (36);

a movable seat (20) having a movable hook (22) formed at a front bottom end thereof, a second pivot hole (24) defined at a top end thereof and in alignment with the first pivot holes (18) for the first pivot pin (180) inserted therethrough, a baffle plate movably received inside the movable seat and being suitable to selectively engage with a second axle of the dipper bucket and a lever pivotally engaged with the baffle plate at a distal edge of the lever, the lever comprising a bar (27) formed on a rear side of the movable seat to limit the pivotal movement of the lever;

a vertical link (40) having a first end pivotally mounted in the body (10) by the first pivot pin (160), and a second end pivotally mounted with an actuating link (48);

a short link (42) having a first end pivotally mounted on the movable seat (30) and between the movable hook (22) and the second pivot hole (24), and a second end pivotally mounted with the first end of the vertical link (40); and a lateral link (46) having a first end pivotally mounted on the arm (44) and a second end pivotally mounted with the second end of the vertical link (40), whereby, by pivoting the actuating link (48), the dipper bucket (50) is rapidly assembled on the fastener with the first axle (51) attached by the fixed hook (11) and a second axle (52) attached by the movable hook (22).

2. The bucket fastener for a hydraulic shovel as claimed in claim 1, wherein the body (10) further comprises a pair of arcuate edge (12) respectively formed at bottom portions of the side walls thereof.

3. The bucket fastener for a hydraulic shovel as claimed in claim 2 further comprising a pole movably received in the body to selectively engage the lever to actuate the pivotal movement of the lever.

4. The bucket fastener for a hydraulic shovel as claimed in claim 3 further comprising a first spring mounted in the body to provide a recoil force to the pole.

5. The bucket fastener for a hydraulic shovel as claimed in claim 1 further comprising a pole movably received in the body to selectively engage the lever to actuate the pivotal movement of the lever.

6. The bucket fastener for a hydraulic shovel as claimed in claim 5 further comprising a first spring mounted in the body to provide a recoil force to the pole.

7. The bucket fastener for a hydraulic shovel as claimed in claim 1, wherein the body (10) has a pair of arm holes (14) respectively defined at upper front ends of the side walls thereof for the arm (44) pivotally mounted therein.

8. The bucket fastener for a hydraulic shovel as claimed in claim 7 further comprising a pole movably received in the body to selectively engage the lever to actuate the pivotal movement of the lever.

9. The bucket fastener for a hydraulic shovel as claimed in claim 8 further comprising a first spring mounted in the body to provide a recoil force to the pole.

10. The bucket fastener for a hydraulic shovel as claimed in claim 1 further comprising a pole movably received in the body to selectively engage the lever to actuate the pivotal movement of the lever.

11. The bucket fastener for a hydraulic shovel as claimed in claim 10 further comprising a first spring mounted in the body to provide a recoil force to the pole.

* * * * *